US007568635B2

(12) United States Patent
Micheli

(10) Patent No.: US 7,568,635 B2
(45) Date of Patent: Aug. 4, 2009

(54) TURBO SPRAY NOZZLE AND SPRAY COATING DEVICE INCORPORATING SAME

(75) Inventor: Paul R. Micheli, Glen Ellyn, IL (US)

(73) Assignee: Illinois Tool Works Inc., Glenview, IL (US)

( * ) Notice: Subject to any disclaimer, the term of this patent is extended or adjusted under 35 U.S.C. 154(b) by 514 days.

(21) Appl. No.: 10/951,470

(22) Filed: Sep. 28, 2004

(65) Prior Publication Data

US 2006/0065760 A1 Mar. 30, 2006

(51) Int. Cl.
*B05B 3/04* (2006.01)

(52) U.S. Cl. ..... 239/263; 239/240; 239/380; 239/456; 239/460; 239/501

(58) Field of Classification Search ..... 239/263, 239/380, 381, 263.3, 240, 457, 458, 460, 239/501, 500, 541, 487, 465, 466, 464, 463, 239/237, 256–258, 253, 251, 252, 246–249, 239/263.1, 263.2, 452, 453, 456, 222–224
See application file for complete search history.

(56) References Cited

U.S. PATENT DOCUMENTS 1,650,128 A 11/1927 Hubbard
2,017,467 A * 10/1935 Loomis ..... 239/118
2,025,953 A * 12/1935 Marchaut ..... 239/383
2,246,211 A 6/1941 Kilich
2,303,280 A 11/1942 Jenkins
2,503,723 A * 4/1950 Gothard ..... 239/240
2,956,752 A * 10/1960 Wahlin ..... 239/526
3,190,564 A 6/1965 Liedberg
3,734,406 A 5/1973 Runstadler, Jr. et al.
3,946,947 A 3/1976 Schneider
3,987,963 A * 10/1976 Pacht ..... 239/124
4,137,928 A * 2/1979 Sentell ..... 134/167 C
4,159,082 A 6/1979 Luderer et al.

(Continued)

OTHER PUBLICATIONS

Spanogle et al.; Development of an Impinging-Jet Fuel-Injection Valve Nozzle; Langley Memorial Aeronautical Laboratory, National Advisory Committee for Aeronautics; Technical Note No. 372, 1931.

*Primary Examiner*—Christopher S Kim
(74) *Attorney, Agent, or Firm*—Fletcher Yoder

(57) ABSTRACT

A system and method is provided for atomizing a liquid without the use of air to atomize the liquid. The system comprises a turbo spray nozzle that has a rotatable shaft. The rotatable shaft has a center bore with an opening at one end to enable a liquid to flow into the center bore of the rotatable shaft. The rotatable shaft also has a plurality of orifices that extend from the center bore to an outer surface of the rotatable shaft at the end opposite the opening. The rotatable shaft is rotated by pressurized air. The rotation of the shaft causes the liquid flowing into the center bore to be induced into a helical flow path that causes the liquid to disassociate. The system may comprise a spray gun coupled to the turbo spray nozzle. The system may also comprise an air compressor to provide the pressurized air to rotate the rotatable shaft. The system may also comprise a container for the liquid hat may be pressurized to provide a motive force to the liquid.

38 Claims, 5 Drawing Sheets

U.S. PATENT DOCUMENTS 4,330,086 A 5/1982 Nysted
4,632,314 A 12/1986 Smith et al.
4,646,968 A 3/1987 Sablatura
4,899,937 A 2/1990 Haruch
5,074,466 A 12/1991 Santiago
5,170,939 A * 12/1992 Martin ..... 239/112
5,209,405 A 5/1993 Robinson et al.
5,249,746 A 10/1993 Kaneko et al.
5,273,059 A 12/1993 Gross et al.
5,344,078 A 9/1994 Fritz et al.
5,699,967 A 12/1997 Conatser et al.
5,752,657 A * 5/1998 Hogan et al. ..... 239/7
5,803,372 A * 9/1998 Weinstein et al. ..... 239/703
5,918,813 A 7/1999 Rucker
5,922,131 A 7/1999 Haas
6,045,057 A 4/2000 Moore et al.
6,085,996 A 7/2000 Culbertson et al.
6,129,295 A 10/2000 Johannson
6,186,273 B1 2/2001 Goldbach et al.
6,383,560 B1 5/2002 Ledbetter
6,450,422 B1 9/2002 Maggio
6,669,112 B2 12/2003 Reetz, III et al.
6,808,122 B2 10/2004 Micheli
2003/0066905 A1 4/2003 Huffman
2004/0031860 A1 2/2004 Micheli
2004/0046040 A1 3/2004 Micheli
2004/0169093 A1 9/2004 Strong
2004/0195369 A1 10/2004 Strong
2005/0006498 A1 1/2005 Micheli

* cited by examiner

TURBO SPRAY NOZZLE AND SPRAY COATING DEVICE INCORPORATING SAME

BACKGROUND OF THE INVENTION

The present technique relates generally to systems and methods for spraying a coating onto a work product. More specifically, the present technique provides a system and method for spraying a coating onto a work product by utilizing a spinning nozzle to atomize a spray fluid without the use of an electrostatic charge or shaping air.

Spray coating devices are used to spray a coating onto a wide variety of work products. In addition, there are a variety of different types of spray coating devices. Some spray coating devices are manually operated, while others are operated automatically. One example of a spray coating devices is an electrostatic spray gun. Electrostatic spray guns utilize a spinning disc or bell to atomize a coating material, such as paint, by centrifugal action. An electrostatic charge is imparted to the atomized paint particles with a small amount of shaping air to project the particles forward toward the object that is being coated.

However, the use of an electrostatic charge and shaping air increases the complexity of the spray coating device and the systems required to support them. Accordingly, a technique is needed to simplify spray coating devices and their associated support systems.

SUMMARY OF THE INVENTION

A system and method is provided for atomizing a liquid without the use of air to atomize the liquid. The system comprises a turbo spray nozzle that has a rotatable shaft. The rotatable shaft has a center bore with an opening at one end to enable a liquid to flow into the center bore of the rotatable shaft. The rotatable shaft also has a plurality of orifices that extend from the center bore to an outer surface of the rotatable shaft at the end opposite the opening. The rotatable shaft is rotated by pressurized air. The rotation of the shaft causes the liquid flowing into the center bore to be induced into a helical flow path that causes the liquid to disassociate. The system may comprise a spray gun coupled to the turbo spray nozzle. The system may also comprise an air compressor to provide the pressurized air to rotate the rotatable shaft. The system may also comprise a container for the liquid hat may be pressurized to provide a motive force to the liquid.

BRIEF DESCRIPTION OF THE DRAWINGS

The foregoing and other advantages of the invention will become apparent upon reading the following detailed description and upon reference to the drawings in which.

DETAILED DESCRIPTION OF SPECIFIC EMBODIMENTS

Figure 1:
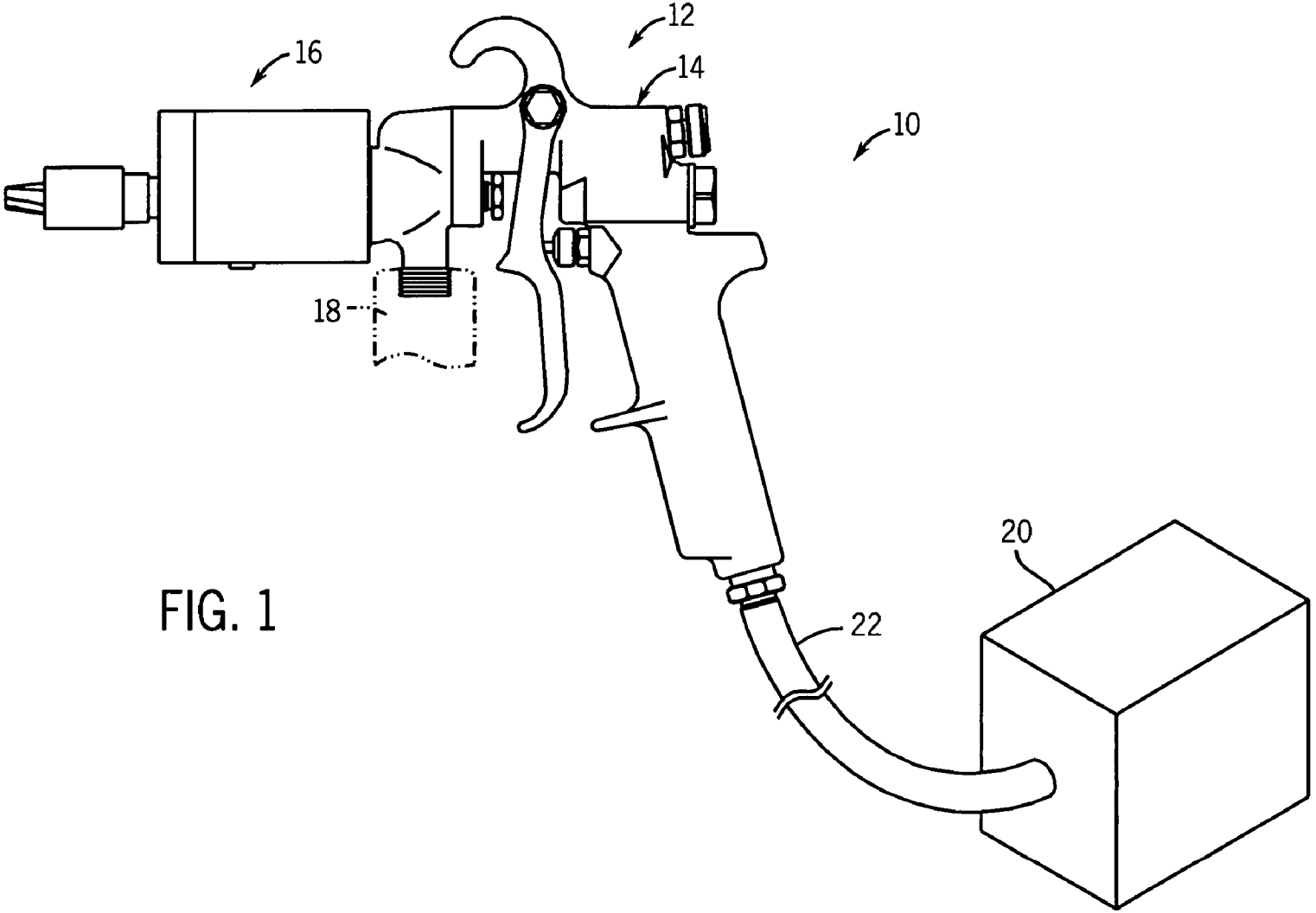
FIG. 1 is a diagram illustrating an exemplary spray coating system, in accordance with an exemplary embodiment of the present technique.

Referring generally to FIG. 1, a spray coating system, represented generally by reference numeral 10, is illustrated. The spray coating system 10 comprises a spray coating device 12 having a spray gun 14 and a turbo spray nozzle 16. The term "spray gun" refers to devices used in robotic spray coating devices that are operated automatically, as well as devices that are held and operated manually. The illustrated spray coating device 12 also comprises a coating material source 18 that is operable to supply coating material to the spray coating device 12. The coating material source 18 may be a pressure pot that is securable to the spray gun 14 to enable the spray coating system 10 to be portable. Alternatively, the coating material source 18 may be a supply line from a fixed coating supply system, such as used in a manufacturing facility. In this embodiment, the coating material source 18 is pressurized to provide a motive force to propel the coating material through the turbo spray nozzle 16. In addition, the illustrated spray coating system 10 comprises an air compressor 20 that is coupled to the spray coating device 12 by an air hose 22. The air compressor 20 and the air hose 22 are used to supply pressurized air to the spray coating device 12. The air compressor 20 and air hose 22 may also be used to pressurize the pressure pot, if a pressure pot is used.

In the illustrated embodiment, the coating material is coupled to the turbo spray nozzle 16 from the coating material source 18 via the spray gun 14. In addition, the spray gun 14 also couples pressurized air to the turbo spray nozzle 16. As will be discussed in more detail below, the turbo spray nozzle 16 uses the pressurized air from the air compressor 20 to induce a centrifugal action in the coating material that causes the coating material to disassociate. The disassociation of the coating material facilitates the atomization of the coating material as it is sprayed from the turbo spray nozzle 16. In addition, the spray coating device 12 maintains the pressurized air and the coating material isolated from each other so that air is not entrapped with the coating material.

Figure 2:
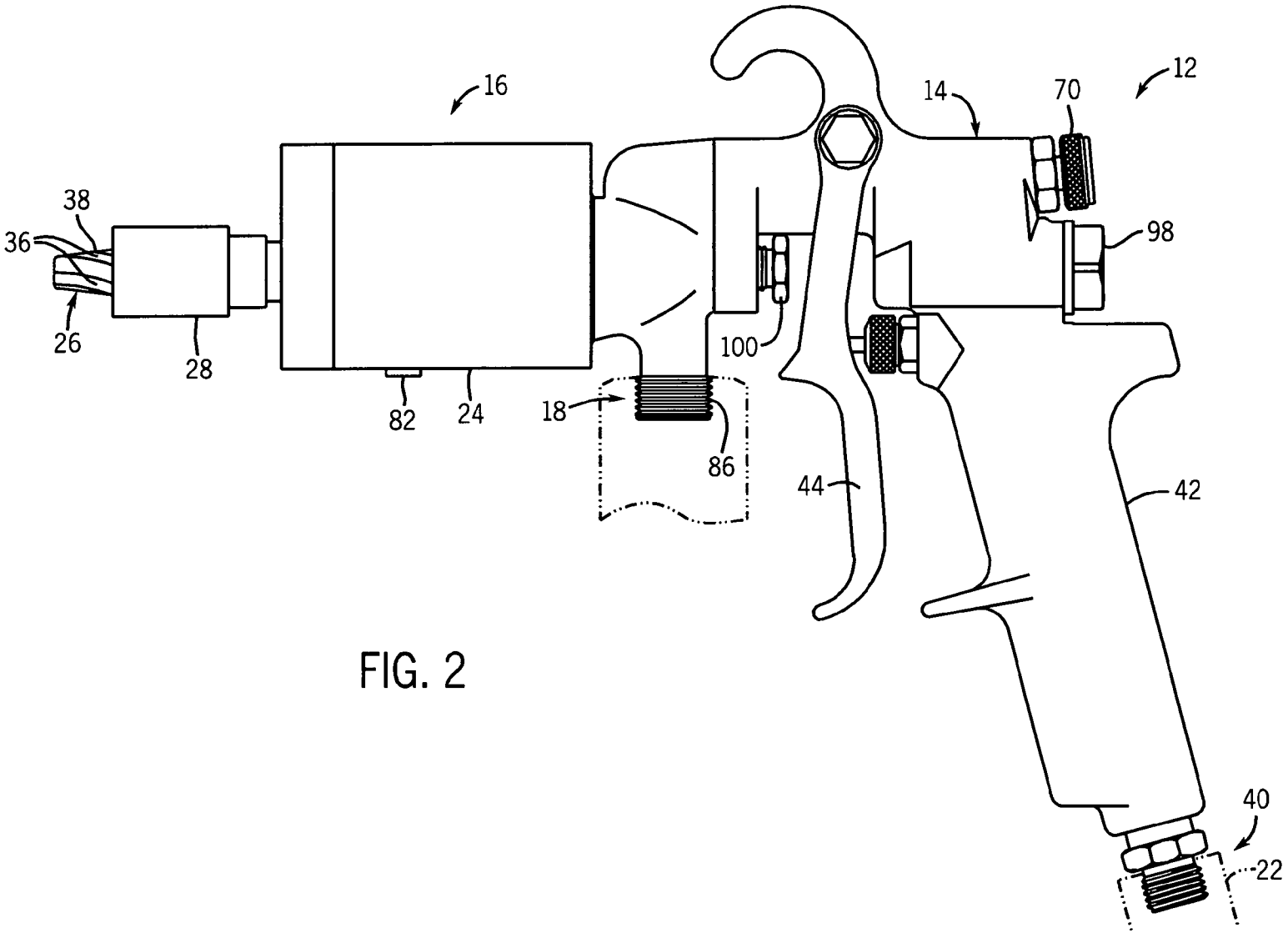
FIG. 2 is an elevation view of a spray coating device having a turbo spray nozzle, in accordance with an exemplary embodiment of the present technique.
Figure 3:
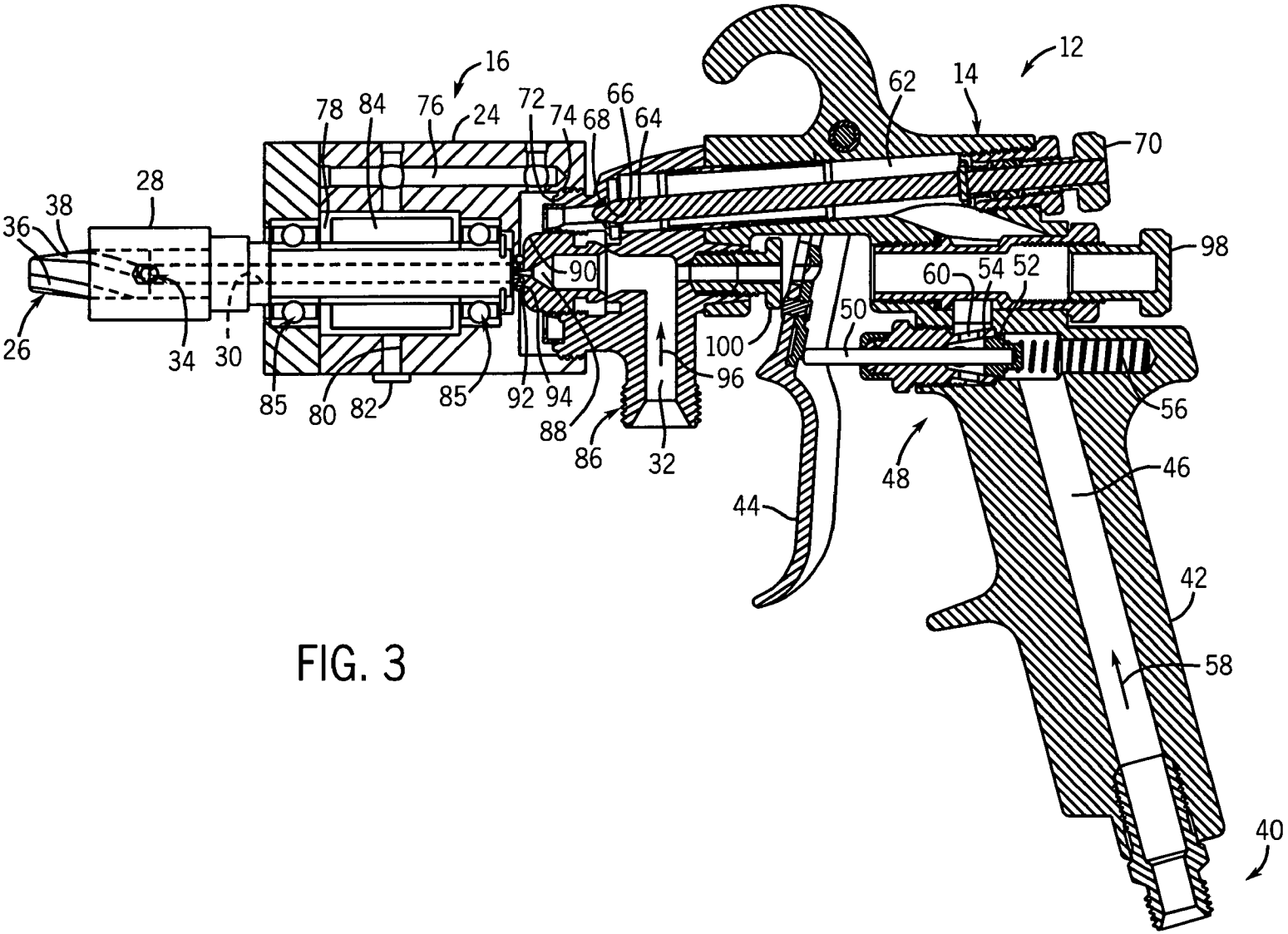
FIG. 3 is a cross-sectional view of the spray coating device having a turbo spray nozzle of FIG. 2.

Referring generally to FIGS. 2 and 3, the illustrated embodiment of the turbo spray nozzle 16 comprises a housing 24, a rotatable shaft 26, and a movable sleeve 28. The rotatable shaft 26 is free to rotate within the housing 24 and is rotated by pressurized air flowing through the housing 24. Spray coating material is conveyed through the rotatable shaft 26. The rotation of the rotatable shaft 26 induces a centrifugal action on the coating material that causes the coating material to spiral as it flows through the rotatable shaft 26, which, in turn, causes the coating material to disassociate. The faster the rotatable shaft rotates, the greater the amount of disassociation in the coating material. As will be discussed in greater detail below, the movable sleeve 28 is selectively positionable along a length of the rotatable shaft 26 to enable a user to adjust the spread of the spray pattern produced by the turbo spray nozzle 16.

As best illustrated in FIG. 3, the rotatable shaft 26 has a center bore 30 that receives coating material from the coating material source 18 via a passageway 32 in the spray gun 14. The illustrated rotatable shaft 26 has a plurality of orifices 34 that are located in grooves 36 within the rotatable shaft 26. In this embodiment, the rotatable shaft 26 has a tapered nozzle 38 that provides an unobstructed flow path for the coating material to flow from the grooves 36 to the atmosphere. The grooves 36 extend helically around the rotatable shaft 26 at the tapered end 38. As noted above, the pressurized air from the air compressor 20 (illustrated in FIG. 1) is used to rotate the rotatable shaft 26. The pressure of the coating material in the coating material source 18 forces the coating material to be sprayed from the turbo spray nozzle 16 via the orifices 34. At the same time, the pressurized air causes the rotatable shaft 26 to rotate as the coating material is sprayed from the turbo spray nozzle. The diameter of the orifices may be established based on the viscosity of the coating material. For example, a rotatable shaft 26 may be made with the diameter of the plurality of orifices 34 established for use with a coating material having a specific viscosity. A more viscous coating material may require a larger diameter orifice 34 than a less viscous coating material.

As discussed in more detail below, the sleeve 28 is disposed over the orifices 34 and a portion of the grooves 36 in the rotatable shaft 26 to enable the user to shape the pattern of the spray produced by the turbo spray nozzle 16. For example, the spread of the spray pattern produced by the turbo spray nozzle 16 may be adjusted by positioning the sleeve to cover more or less of the grooves 36. Alternatively, a portion of the pressurized air may be directed to shape the spray as it exits the turbo spray nozzle 16.

Figure 4:
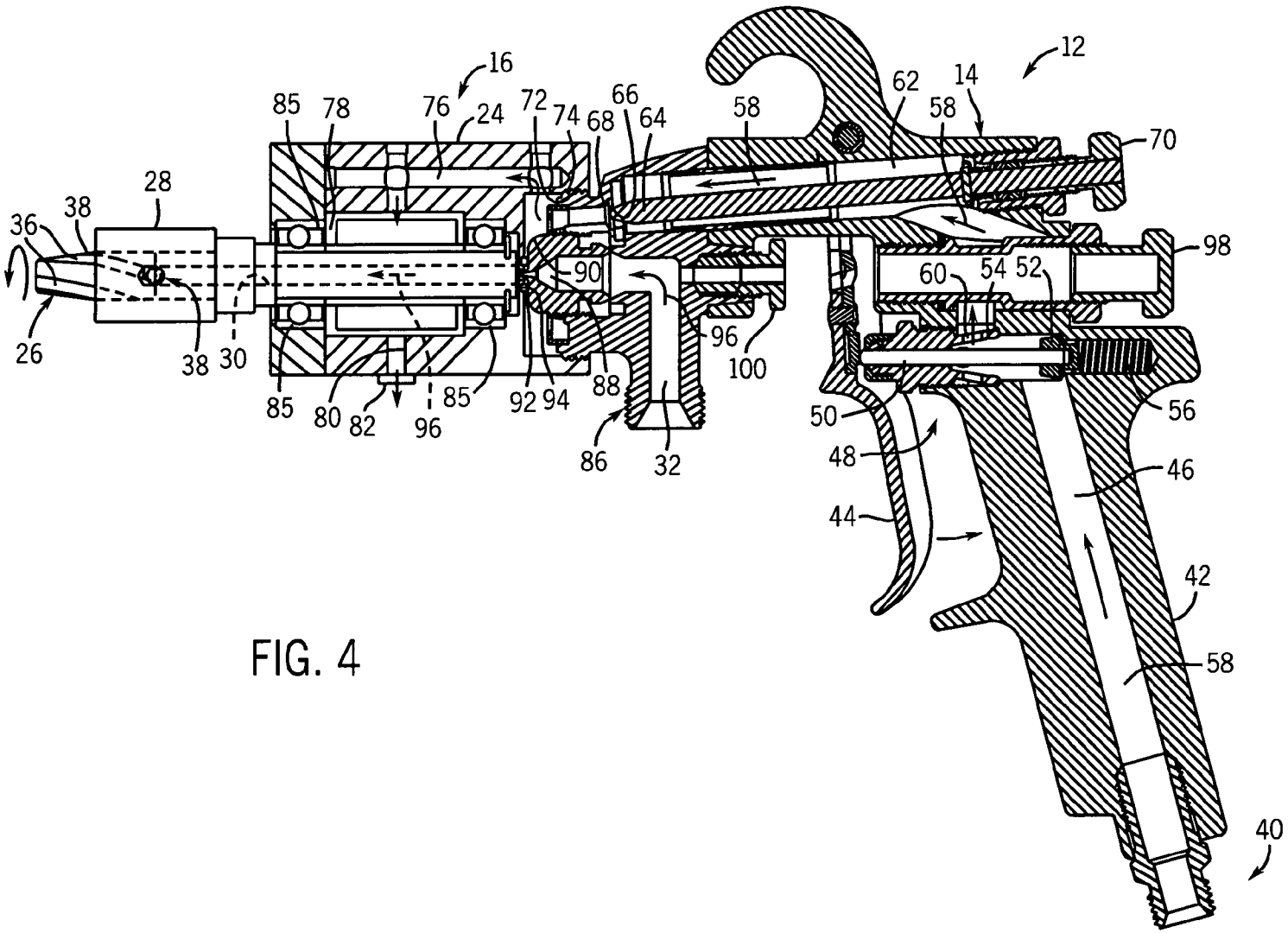
FIG. 4 is a cross-sectional view of the spray coating device having a turbo spray nozzle of FIG. 2, illustrating the operation of the spray coating device.

Referring generally to FIGS. 3 and 4, the spray gun 14 has an air fitting 40 that enables the air hose 22 from the air compressor 20 to be connected to the spray gun 14. The spray gun 14 has a handle 42 to enable a user to grip the spray gun 14 and operate a trigger 44 that controls the flow of pressurized air through the spray gun 14. However, rather than having a handle 42, the spray coating device 12 may be part of a robotic spraying system, such as used in a manufacturing environment.

In this embodiment, a passageway 46 extends through the handle 42 to a valve assembly 48. The valve assembly 48 comprises a stem 50, a valve 52, a seat 54, and a spring 56. The stem 50 is connected to the valve 52. The spring 56 is biased to urge the valve 52 against the seat 54, blocking the flow of air through passageway 46. However, when the trigger 44 is squeezed to overcome the bias of the spring 56, the valve 52 is displaced relative to the seat 54. This displacement of the valve 52 relative to the seat 54 provides a path for pressurized air 58 to flow though the valve assembly 48 via an opening 60 in the seat 54.

When the valve assembly 48 is open, pressurized air 58 flows from the valve assembly 48 to an additional passageway 62 in the spray gun 14. A valve stem 64 is disposed in the passageway 62. The valve stem 64 has a conical valve surface 66. The spray gun 14 has a corresponding seating surface 68 disposed opposite the valve surface 66. A control knob 70 is provided to enable a user to establish a desired flow rate of pressurized air 58 to the turbo spray nozzle 16 when the trigger 44 is operated. The control knob 70 enables a user to control the position of the valve stem 64 so as to control the displacement of the valve surface 66 relative to the seating surface 68. The greater the displacement of the valve surface 66 relative to the seating surface 68, the greater the flow rate of air 58 that flows to the turbo spray nozzle 16. In addition, the flow rate of pressurized air 58 to the turbo spray nozzle 16 is controllable by controlling the position of the trigger 44. The greater the trigger 44 is depressed, the greater the flow rate of pressurized air 58 flowing through the valve assembly 48 to the turbo spray nozzle 16.

In the illustrated embodiment, the turbo spray nozzle 16 is threadably secured to the spray gun 14. The housing 24 of the turbo spray nozzle 16 has a threaded portion 72 and the spray gun 14 has a corresponding threaded portion 74 operable to receive the threaded portion 72 of the housing 24. In addition, the housing 24 has a passageway 76 that couples pressurized air 58 to an interior chamber 78 of the housing 24. The housing 24 also has an exit opening 80. A rotor 84 is secured over the rotatable shaft 26 to enable the pressurized air 58 to induce rotation in the rotatable shaft 26. When the trigger 44 is depressed, pressurized air 58 flows through the passageway 76 and around the rotatable shaft 26 to the exit opening 80. A muffler 82 is provided to reduce the noise produced by the flow of pressurized air 58 from the turbo spray nozzle 16. The air 58 flowing around the rotatable shaft 26 to the exit opening 80 induces the rotor 84 to rotate the rotatable shaft 26. The turbo spray nozzle 16 has a pair of bearings 84 that support the rotatable shaft 26 and enable the rotatable shaft 26 to rotate.

The spray gun 14 has a fitting 86 that enables the coating material source 18 to be secured to the spray gun 14. The fitting 86 is in fluid communication with the passageway 32 through the spray gun 14. The passageway 32 has a tapered portion 88 at the end of the passageway 32 opposite the fitting 86. Coating material 90 is directed into the passageway 32 through the fitting 86. The tapered portion 88 of the passageway 32 funnels the coating material 90 toward the center bore 30 of the rotatable shaft 26 of the turbo spray nozzle 16. The diameter of the inlet of the center bore 30 of the rotatable shaft 26 is wider than the diameter of the outlet of the tapered portion 88 of the passageway 32. A seal 92, such as an o-ring, is disposed on an end surface 94 of the housing 24 so that a seal is formed between the end surface of the housing 24 and an end surface 96 of the spray gun 14. The seal 92 isolates the coating material 90 from the pressurized air 58. Alternatively, the coating material source 18 could be connected directly to the housing 24 of the turbo spray nozzle 16, rather than via the spray gun 14. Furthermore, the pressurized air 58 could be connected directly to the turbo spray nozzle 16 also.

As noted above, the coating material source 18 is pressurized. The pressure forces the coating material 90 into the center bore 30 of the rotatable shaft 26. The rotation of the rotatable shaft 26 induces a spiraling motion in the coating material 90 as it is directed through the center bore 30 in the rotatable shaft 26. The centrifugal action of the rotatable shaft 26 disassociates the coating material 90 and causes the coating material 90 to atomize. The atomized particles of coating material 90 become finer the faster the rotatable shaft 26 rotates. In addition, the angled flow path for the coating material 90 as it flows from the center bore 30 into the grooves 36 via the orifices 34 establishes a forward direction to the flow of coating material 90 from the tapered nozzle 38 of the rotatable shaft 26. The forward direction of the flow of coating material 90 combined with the tapered shape of the nozzle 36 causes the coating material 90 to wrap around the tapered nozzle 36 as the rotatable shaft 26 rotates producing a tight spray pattern.

In the illustrated embodiment, the spray coating device 12 has been modified for use with a spray gun 14 configured to atomize the coating material 90 with pressurized air 58. Caps 98 and 100 are provided to seal openings in the spray gun 14 that would normally be used to enable atomizing air to be coupled to the spray fluid. However, since the pressurized air 58 is isolated from the coating material 90 in the illustrated spray coating device 12, the caps 98 and 100 are provided to seal the openings to maintain the integrity of the air passageway 46 and the spray fluid passageway 32, respectively.

Figure 5:
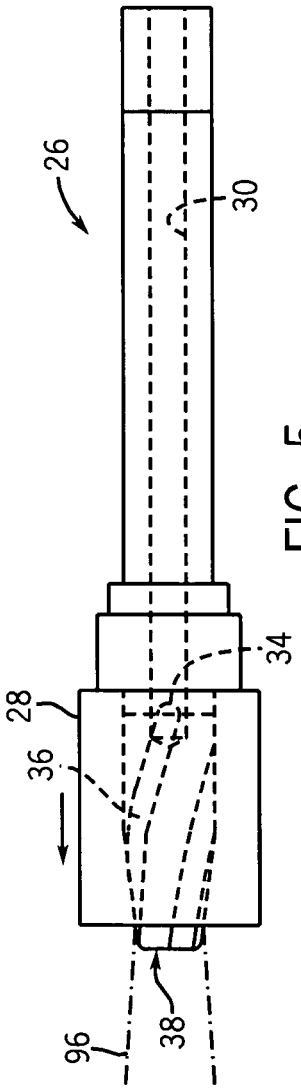
FIG. 5 is an elevation view of the rotatable shaft and movable sleeve of the turbo spray nozzle of FIG. 2, with the movable sleeve in a first position relative to the rotatable shaft.
Figure 6:
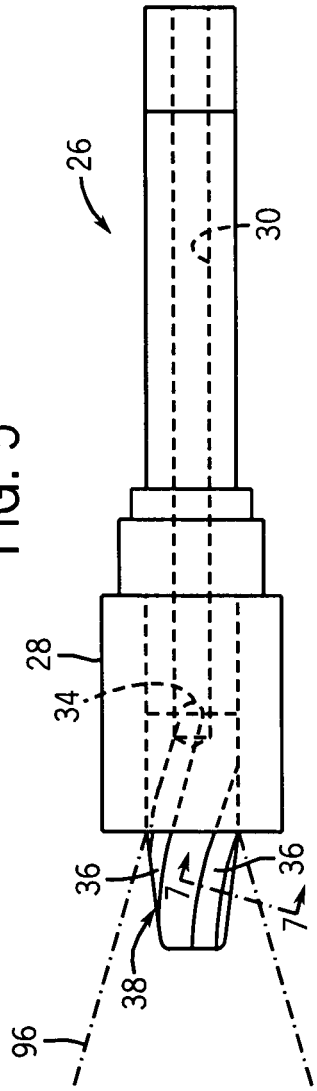
FIG. 6 is an elevation view of the rotatable shaft and movable sleeve of the turbo spray nozzle of FIG. 2, with the movable sleeve in a second position relative to the rotatable shaft.
Figure 7:
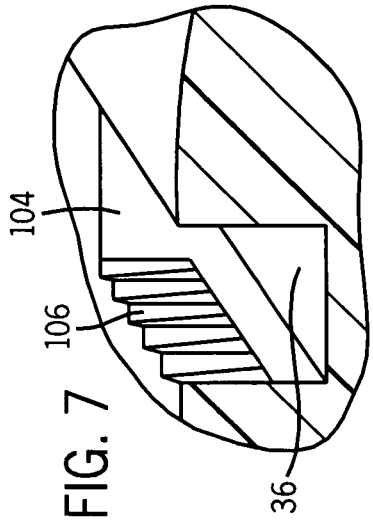
FIG. 7 is a detailed view of a portion of a groove of the tapered nozzle of the rotatable shaft of FIG. 5.

Referring generally to FIGS. 5-7, the spread of the spray pattern may be adjusted by positioning the sleeve 28 to cover more or less of the grooves 36. The angled path that the coating material 90 takes as it flows into the grooves 36 via the orifices 34, in combination with the rotation of the rotatable shaft 26, causes the turbo spray nozzle 16 to produce a conical spray pattern that wraps around the rotatable shaft 26. By positioning the sleeve 28 relative to the rotatable shaft 26, the angle that the coating material 90 takes as it leaves the turbo spray nozzle 16 to change, thereby changing the size of the spray pattern at a given distance from the turbo spray nozzle 16. For example, the spray pattern produced by the turbo spray nozzle 16 will decrease in diameter as the sleeve 28 is moved toward the end of the rotatable shaft 26, as represented in FIG. 5. The sleeve 28 covers a greater portion of the grooves 36 in this position causing the angle of the spray pattern to decrease. Conversely, the spread of the spray pattern will increase as the sleeve is moved towards the housing 24 in the opposite direction, as represented in FIG. 6, thereby uncovering a greater portion of the grooves 36. The sleeve 28 uncovers a greater portion of the grooves 36 in this position causing the angle of the spray pattern to increase.

Figure 8:
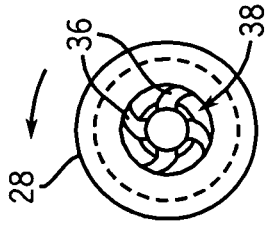
FIG. 8 is an end view of the rotatable shaft and movable sleeve of FIG. 4.

Referring generally to FIGS. 7 and 8, each groove 36 in the rotatable shaft 26 has a serrated portion 102 along a sidewall 104 of the groove 36. The sidewalls 104 extend generally vertically. In addition, the sidewalls 104 have a sharp top edge 106 along the top of each sidewall 104. The centrifugal action on the coating material 96 caused by the rotation of the rotatable shaft 26 causes the coating material 96 to be directed against the serrated portion 102 and the edge 106 of the sidewall 104 of each groove 36. The contact of the serrated portion 102, in particular, and the sharp edge 106 of the sidewall 104 against the coating material 96 causes the coating material 96 to disassociate. In addition, the disassociation of the coating material 96 occurs without the use of pressurized air.

Figure 9:
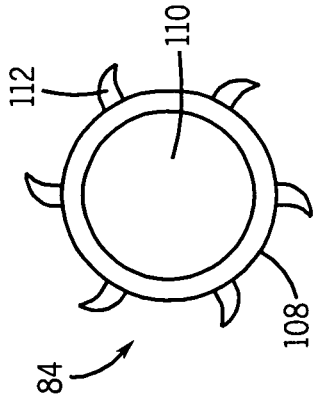
FIG. 9 is an end view of the rotor of the turbo spray nozzle of FIG. 3.

Referring generally to FIG. 9, an embodiment of the rotor 84 is illustrated. The rotor 84 has a tubular portion 108 with a central opening 110 extending therethrough to enable the rotor 84 to be disposed over the rotatable shaft 26, as illustrated in FIGS. 3 and 4. The rotor 84 has a plurality of blades 112. The pressurized air flowing through the housing 24 of the turbo spray nozzle 16 strikes the blades 112 and induces rotation of the rotor 84, and thereby induces rotation of the rotatable shaft 26.

The techniques described above provide a number of benefits to improve the operation of the illustrated spray coating system 10 over previous systems. First, no electrostatic charge or pressurized air is utilized to atomize the spray fluid. Because pressurized air is not used to atomize the spray fluid, less air volume is needed to operate the spray coating device. Thus, a smaller air compressor may be used with the system, which increases the portability of the system. In addition, no air is entrapped in the spray fluid because the spray fluid is isolated from the pressurized air. Air entrapment gives a coating a hazy appearance. Furthermore, the effects of overspray and bounce-back of the spray fluid are eliminated because pressurized air is not used to shape or atomize the spray fluid. However, pressurized air may be used in shaping the spray pattern.

What is claimed is:

1. A spray coating system, comprising:

a spray gun comprising an air passage and a liquid coating passage; and a spray head coupled to the spray gun, wherein the spray head comprises a spray nozzle comprising:

a rotatable shaft having a center bore, a plurality of radial passages, and a plurality of spiral shaped grooves disposed on a tapered outer surface of the rotatable shaft, wherein the radial passages extend outwardly through the rotatable shaft from the center bore to the respective spiral shaped grooves, the spiral shaped grooves include spray formation exits;

a drive mechanism coupled to the rotatable shaft, wherein the drive mechanism is configured to rotate the rotatable shaft; and a movable sleeve disposed over the rotatable shaft and enclosing portions of the spiral shaped grooves.

2. The spray coating system as recited in claim 1, wherein each groove in the plurality of spiral shaped grooves has a seffated portion.

3. The spray coating system as recited in claim 1, wherein each groove in the plurality of spiral shaped grooves has a generally vertical sidewall with a sharp top edge.

4. The spray coating system as recited in claim 1, wherein the sleeve is selectively positionable along an axial length of the rotatable shaft.

5. The spray coating system as recited in claim 1, wherein the spray gun comprises a housing having the air passage, the liquid passage, and the drive mechanism coupled to a first end portion of the rotatable shaft, and the rotatable shaft extends outwardly from the housing to a second end portion having the plurality of spiral shaped grooves disposed on the tapered outer surface.

6. The spray coating system as recited in claim 5, comprising a plurality of bearing assemblies disposed within the housing about the rotatable shaft.

7. The spray coating system as recited in claim 6, wherein the drive mechanism comprises a plurality of air-driven blades disposed about the rotatable shaft, and the air passage is directed toward the plurality of air-driven blades to induce rotation of the rotatable shaft.

8. The spray coating system as recited in claim 7, wherein the housing comprises an air inlet and an air outlet in fluid communication with the air passage.

9. The spray coating system as recited in claim 8, wherein the housing comprises a muffler in fluid communication with the air outlet.

10. The spray coating system as recited in claim 1, wherein the air passage comprises an air inlet fitting configured to couple with an air compressor via an air hose.

11. The spray coating system as recited in claim 1, comprising a pot operable to house coating material and maintain the coating material pressurized, the pot being coupleable to the spray gun.

12. The spray coating system as recited in claim 1, wherein the spray gun comprises a trigger coupled to a valve assembly operable to vary the flow rate of pressurized air flowing to the spray nozzle.

13. The spray coating system as recited in claim 12, wherein the spray gun comprises a throttle valve operable to establish a desired flow rate of pressurized air to the spray nozzle with the valve assembly open.

14. The spray coating system as recited in claim 1, wherein the plurality of spiral shaped grooves generally spiral about a conical outer surface that becomes increasingly smaller in diameter in a downstream direction, the movable sleeve has a cylindrical inner surface, and an annular space between the conical outer surface and the cylindrical inner surface increases as the movable sleeve moves in the downstream direction.

15. The spray coating system as recited in claim 1, wherein the plurality of spiral shaped grooves are configured to direct the pressurized coating material both axially forward and radially outward relative to an axis of the rotatable shaft.

16. The spray coating system as recited in claim 1, wherein the movable sleeve moves lengthwise along an axis of the rotatable shaft, wherein the movable sleeve and the spiral shaped grooves define the spray formation exits at a plurality of different positions along the rotatable shaft to vary a spray pattern.

17. The spray coating system of claim 16, wherein the sleeve and the grooves define the spray formation exits at the plurality of different positions between the tapered outer surface of the rotatable shaft and a suffounding interior surface of the sleeve.

18. The spray coating system of claim 1, wherein the liquid passage leads to the spray head.

19. The spray coating system of claim 1, wherein the spiral shaped grooves are configured to guide a liquid coating from the radial passages to the spray formation exits.

20. A spray coating system, comprising:

a spray gun;

a drive comprising a plurality of air-driven blades disposed about a rotatable shaft, and wherein the drive is coupled to an air passage that is directed toward the plurality of air-driven blades to induce rotation of the rotatable shaft; and a spray nozzle coupled to the spray gun and rotatable by the drive, wherein the spray nozzle comprises:

a plurality of spiral shaped fluid paths disposed about a rotational shaft, wherein the spiral shaped fluid paths comprise closed passages extending to respective exit ports, and the spiral shaped fluid paths are configured to rotate and pass a coating fluid outwardly from the respective exit ports to create a spray; and a movable sleeve disposed about the spiral shaped fluid paths;

wherein the movable sleeve is selectively positionable along the length of the rotational shaft to vary a spray pattern.

21. The spray coating system of claim 20, wherein the closed passages of the respective spiral shaped fluid paths are disposed between the shaft and the movable sleeve.

22. The spray coating system of claim 21, wherein the shaft does not translate.

23. The spray coating system of claim 21, wherein the movable sleeve is moveable lengthwise along the shaft to vary positions of the respective exit ports relative to the rotational shaft.

24. The spray coating system of claim 21, wherein the shaft comprises a center bore leading to the plurality of spiral shaped fluid paths, and wherein the plurality of spiral shaped fluid paths is disposed on an outer surface of the shaft that faces away from the rotational shaft.

25. The spray coating system of claim 24, wherein the outer surface of the shaft and the plurality of spiral shaped grooves are tapered relative to an axis of the shaft at the exit ports.

26. The spray coating system of claim 20, wherein the spiral shaped fluid paths extend beyond the respective exit ports.

27. The spray coating system of claim 20, wherein the spiral shaped fluid paths are disposed on a conical outer surface of the rotatable shaft,.

28. The spray coating system of claim 20, wherein the movable sleeve comprises a straight cylindrical tube that is coaxial with the rotational shaft along the entire length of the movable sleeve.

29. A spray coating system, comprising:

a spray gun having a head; and a spray nozzle coupled to the head of the spray gun, comprising:

a shaft comprising a plurality of grooves, wherein the shaft comprises a conical exterior portion;

a sleeve disposed about the shaft to close portions of the grooves and define exit ports, respectively, wherein the sleeve moves lengthwise along shaft to vary positions of the respective exit ports to vary a spray pattern of liquid passing though the closed portions and exiting from the exit ports of the plurality of grooves, respectively, and the plurality of grooves are disposed on the conical exterior portion.

30. The spray coating system of claim 29, wherein the plurality of grooves spiral about an axis of the shaft.

31. The spray coating system of claim 29, wherein the shaft comprises a central bore and a plurality of radial bores leading from the central bore to the plurality of grooves.

32. The spray coating system of claim 29, wherein the shaft is rotatable.

33. The spray coating system of claim 29, wherein the plurality of grooves is disposed on an outer surface of the shaft in a generally helical pattern centered about a rotational axis of the shaft.

34. The spray coating system as recited in claim 29, wherein the sleeve moves lengthwise along the shaft to define the exits ports at different positions along the conical exterior portion, wherein each different position has a different diameter of the shaft.

35. The spray coating system as recited in claim 29, wherein the plurality of grooves extend lengthwise along the shaft further downstream beyond the exit ports.

36. The spray coating system of claim 29, comprising a drive configured to induce rotation of the rotatable shaft.

37. The spray coating system of claim 36, wherein the drive comprises a plurality of air-driven blades disposed about the rotatable shaft, and wherein the drive is coupled to an air passage that is directed toward the plurality of air-driven blades to induce the rotation of the rotatable shaft.

38. A spray coating system, comprising:

a spray gun having a head; and a spray nozzle coupled to the head of the spray gun, comprising:

a shaft comprising a plurality of grooves;

a sleeve disposed about the shaft to close portions of the grooves and define exit ports, respectively, wherein the sleeve moves lengthwise along shaft to vary positions of the respective exit ports to vary a spray pattern of liquid passing though the closed portions and exiting from the exit ports of the plurality of grooves, respectively;

a drive configured to induce rotation of the rotatable shaft, wherein the drive comprises a plurality of air-driven blades disposed about the rotatable shaft, and the drive is coupled to an air passage that is directed toward the plurality of air-driven blades to induce the rotation of the rotatable shaft.

* * * * *

UNITED STATES PATENT AND TRADEMARK OFFICE
Certificate

Patent No. 7,568,635 B2 Patented: August 4, 2009

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Paul R. Micheli, Glen Ellyn, IL (US); and Gary Schwebemeyer, Sylvania, OH (US).

Signed and Sealed this Twentieth day of April 2010.

LEN TRAN
*Supervisory Patent Examiner*
Art Unit 3752

UNITED STATES PATENT AND TRADEMARK OFFICE

CERTIFICATE OF CORRECTION

PATENT NO. : 7,568,635 B2
APPLICATION NO. : 10/951470
DATED : August 4, 2009
INVENTOR(S) : Paul R. Micheli It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 720 days.

Signed and Sealed this

Seventh Day of September, 2010

David J. Kappos

David J. Kappos
*Director of the United States Patent and Trademark Office*